US007488161B2

(12) United States Patent
Inoue et al.

(10) Patent No.: US 7,488,161 B2
(45) Date of Patent: Feb. 10, 2009

(54) HIGH PRESSURE PUMP HAVING DOWNSIZED STRUCTURE

(75) Inventors: Hiroshi Inoue, Anjo (JP); Nobuo Ota, Takahama (JP); Yoshitsugu Inaguma, Chita-gun (JP); Kaoru Oda, Toyokawa (JP); Tatsumi Oguri, Okazaki (JP)

(73) Assignee: Denso Corporation (JP)

( * ) Notice: Subject to any disclaimer, the term of this patent is extended or adjusted under 35 U.S.C. 154(b) by 342 days.

(21) Appl. No.: 11/330,109

(22) Filed: Jan. 12, 2006

(65) Prior Publication Data

US 2006/0159573 A1 Jul. 20, 2006

(30) Foreign Application Priority Data

Jan. 17, 2005 (JP) ..... 2005-009020
Jan. 28, 2005 (JP) ..... 2005-020925

(51) Int. Cl.
*F04B 35/04* (2006.01)

(52) U.S. Cl. ..... 417/470; 417/307; 417/505; 251/129.15; 123/467

(58) Field of Classification Search ..... 417/307, 417/505, 506, 446, 456, 415, 410.3, 410.4, 417/423.14, 470; 123/467, 468, 469, 472, 123/490, 499; 239/584, 585.1; 251/129.15, 251/129.2

See application file for complete search history.

(56) References Cited

U.S. PATENT DOCUMENTS 4,241,714 A * 12/1980 Knape et al. ..... 123/499
4,343,280 A * 8/1982 Luscomb ..... 123/459
4,408,718 A * 10/1983 Wich ..... 239/88
4,485,969 A * 12/1984 Deckard et al. ..... 239/88
4,540,122 A * 9/1985 Teerman ..... 239/88
5,360,164 A * 11/1994 Pape et al. ..... 239/88
5,370,095 A * 12/1994 Yamaguchi et al. ..... 123/446
5,443,209 A * 8/1995 VanAllsburg ..... 239/90
5,743,238 A * 4/1998 Shorey et al. ..... 123/506
6,036,460 A * 3/2000 Christ et al. ..... 417/505
6,345,608 B1 2/2002 Rembold et al.

(Continued)

OTHER PUBLICATIONS

Chinese Examination Report mailed Aug. 31, 2007 in Chinese Application No. 200610005465.1 with English translation.

(Continued)

*Primary Examiner*—Charles G Freay
*Assistant Examiner*—Amene S Bayou
(74) *Attorney, Agent, or Firm*—Nixon & Vanderhye PC

(57) ABSTRACT

A high pressure pump has a fuel passage and a pump chamber. Fuel flows into the pump chamber through the fuel passage. The high pressure pump includes a valve member and a plunger. The valve member is movable along a movable axis in a substantially axial direction of the valve member for controlling an amount of fuel flowing into the pump chamber through the fuel passage. The plunger is movable substantially along a movable axis in a substantially axial direction of the plunger. The plunger is capable of pressurizing fuel in the pump chamber to discharge fuel in the pump chamber. The movable axis of the valve member is displaced from the movable axis of the plunger substantially in parallel with each other.

46 Claims, 8 Drawing Sheets

U.S. PATENT DOCUMENTS

| | | | | |
|---|---|---|---|---|
| 6,631,706 | B1 | 10/2003 | Yamada et al. | |
| 6,824,120 | B2 | 11/2004 | Furuta et al. | 251/355 |
| 2003/0056744 | A1* | 3/2003 | Katayama | 123/90.17 |
| 2003/0160197 | A1* | 8/2003 | Kodama | 251/57 |
| 2003/0164161 | A1 | 9/2003 | Usui et al. | |
| 2003/0219346 | A1 | 11/2003 | Abe et al | |
| 2004/0055580 | A1 | 3/2004 | Yamada et al. | |

OTHER PUBLICATIONS

Japanese Official Action, dated Jun. 30, 2008, issued in corresponding Japanese Appln. No. 2005-009020, with English translation.

Japanese Official Action dated Oct. 24, 2008, issued in counterpart Japanese Application No. 2005-020925 with English translation.

* cited by examiner

HIGH PRESSURE PUMP HAVING DOWNSIZED STRUCTURE

CROSS REFERENCE TO RELATED APPLICATIONS

This application is based on and incorporates herein by reference Japanese Patent Applications No. 2005-9020 filed on Jan. 17, 2005 and No. 2005-20925 filed on Jan. 28, 2005.

FIELD OF THE INVENTION

The present invention relates to a high pressure pump that pressurizes fluid using a plunger.

BACKGROUND OF THE INVENTION

Conventionally, a high pressure pump has a plunger, which is driven by an internal combustion engine. The high pressure pump discharges fuel in a pump chamber to the outside of the high pressure pump using the plunger. A valve member controls an amount of fuel flowing into the pump chamber through a fuel passage.

According to WO00/06895 (JP-A-2002-521616, U.S. Pat. No. 6,345,608), a high pressure pump has a movable plunger and a movable valve member. The movable axis of the plunger is substantially coaxial with respect to the movable axis of the valve member. According to WO00/47888 (U.S. Pat. No. 6,631,706, US2004 0055580A1), the movable axis of the plunger is substantially perpendicular to the movable axis of the valve member.

The above high pressure pump having the plunger, is preferably small in consideration of mountability to an engine. However, in the high pressure pump according to WO00/06895, the plunger is substantially coaxial with respect to the valve member. Consequently, the high pressure pump may be jumboized in the axial direction of the plunger. Furthermore, in the high pressure pump according to WO00/06895, a coil portion, which moves the valve member, a part of a fuel passage, and the like are arranged on the opposite side of the plunger with respect to the valve member. Accordingly, the high pressure pump may be further elongated in the axial direction of the plunger.

By contrast, in the high pressure pump according to WO00/47888, the axis of the valve member is displaced with respect to the axis of the plunger in the radial direction thereof. In this structure, the valve member extends in a substantially radial direction of the plunger, accordingly, the high pressure pump may be jumboized in the radial direction of the plunger, even though the high pressure pump can be downsized with respect to the axial direction of the plunger. Furthermore, in the high pressure pump according to WO00/047888, a coil portion, a part of a fuel passage, and the like are arranged on the opposite side of the plunger with respect to the valve member. Accordingly, the high pressure pump may be further elongated in the radial direction of the plunger.

In addition, according to JP-A-2003-254191 (US 2003 0164161A1), a high pressure pump has a plunger that moves back and forth, so that the plunger draws fuel from an inlet chamber into a compression chamber, and pressurizes the fuel in the compression chamber. In this high pressure pump, various components such as a fuel inlet, a control valve, and a discharge valve are assembled to a pump housing.

However, the components may protrude in the radial direction of the high pressure pump or in the axial direction of the high pressure pump, in dependence upon locations, in which the components are provided. When the components excessively protrude from the high pressure pump, the high pressure pump may be jumboized. In addition, when the components excessively protrude to the outside of the high pressure pump, the components may interfere with other components around the high pressure pump, when the high pressure pomp is mounted. Accordingly, mounting work of the high pressure pump may become difficult.

SUMMARY OF THE INVENTION

In view of the foregoing and other problems, it is an object of the present invention to produce a high pressure pump having a plunger, the high pressure pump being small sized in both the axial direction of the plunger and the radial direction of the plunger.

According to one aspect of the present invention, a high pressure pump has a fuel passage and a pump chamber. Fuel flows into the pump chamber through the fuel passage. The high pressure pump includes a valve member and a plunger. The valve member is movable along a movable axis in a substantially axial direction of the valve member for controlling an amount of fuel flowing into the pump chamber through the fuel passage. The plunger is movable substantially along a movable axis in a substantially axial direction of the plunger. The plunger is capable of pressurizing fuel in the pump chamber to discharge fuel in the pump chamber. The movable axis of the valve member is displaced from the movable axis of the plunger substantially in parallel with each other.

Alternatively, a high pressure pump has an inlet chamber and a pump chamber. The high pressure pump includes a plunger and a valve member. The plunger partially defines the pump chamber. The plunger is movable in a substantially axial direction of the plunger. The valve member is movable in a substantially axial direction of the valve member. The valve member is capable of communicating the inlet chamber with the pump chamber and is capable of blocking the inlet chamber from the pump chamber. The axial direction of the valve member is displaced from the axial direction of the plunger substantially in parallel with each other.

A high pressure pump includes an inlet member, a pump housing, an outlet member, and a plunger. The pump housing has an inlet chamber and a compression chamber. Fluid is drawn from the inlet member into the compression chamber through the inlet chamber. Fluid is pressurized in the compression chamber. Fluid flows from the compression chamber through the outlet member. The plunger is movable in the pump housing for pressurizing fluid in the compression chamber.

In the high pressure pump, the inlet chamber has an outer circumferential periphery that includes a discontinuous portion with respect to a circumferential direction of the outer circumferential periphery. The pump housing has a space on an outer side of the discontinuous portion with respect to the circumferential direction of the outer circumferential periphery. The high pressure pump further includes at least one component that is at least partially accommodated in the space.

Alternatively, in the high pressure pump, the inlet chamber has a recessed portion. The pump housing has a space in an outside of the recessed portion. The at least one component is at least partially accommodated in the space.

Alternatively, the inlet chamber has an outer circumferential periphery that includes a linear portion with respect to a circumferential direction of the outer circumferential periphery in the high pressure pump. The pump housing has a space on a circumferentially outer side of the linear portion. The at least one component is at least partially accommodated in the space.

A high pressure pump includes an inlet member, a pump housing, an outlet member, and a plunger. The pump housing has an inlet chamber and a compression chamber. The inlet member communicates with the inlet chamber. The inlet chamber is capable of communicating with the compression chamber. The outlet member is capable of communicating the compression chamber with an outside of the pump housing. The plunger is movable in the pump housing. The plunger partially defines the compression chamber.

In the high pressure pump, the inlet chamber has an outer circumferential periphery that extends from a first end of the outer circumferential periphery to a second end of the outer circumferential periphery. The first end extends to the second end to form a defining portion that defines a space in the pump housing. The space is located on an outer side of the defining portion with respect to a circumferential direction of the outer circumferential periphery. The high pressure pump further includes at least one component that is at least partially accommodated in the space.

Alternatively, in the high pressure pump, the inlet chamber has a plurality of outer circumferential peripheries. Each of the plurality of outer circumferential peripheries has a first end and a second end. The first end extends to the second end in each of the plurality of outer circumferential peripheries. The first end of one of the plurality of outer circumferential peripheries extends to the second end of an other of the plurality of outer circumferential peripheries to define a defining portion. The one of the plurality of outer circumferential peripheries is circumferentially adjacent to the other of the plurality of outer circumferential peripheries. The defining portion defines a space in the pump housing. The space is located on an outer side of the defining portion with respect to a circumferential direction of the outer circumferential periphery. The at least one component is at least partially accommodated in the space.

The at least one component may include at least one of a control valve and the relief valve.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
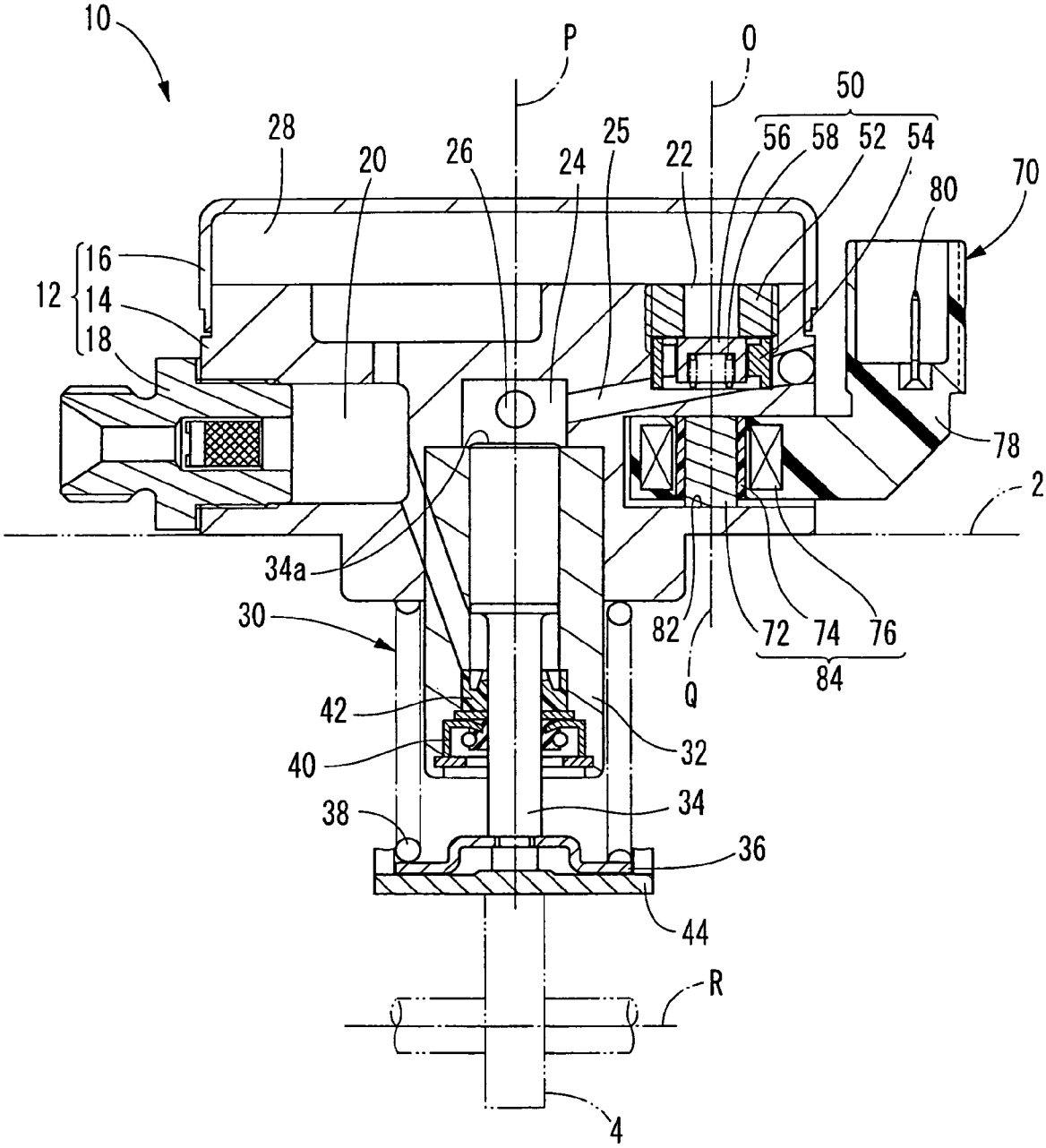
FIG. 1 is a partially cross sectional side view showing a high pressure pump according to a first embodiment of the present invention.

As shown in FIG. 1, a high pressure pump 10 is mounted to an internal combustion engine 2. The high pressure pump 10 is a high pressure supply pump, for example. The high pressure pump 10 pressurizes fuel, supplied from a low pressure pump, using a low pressure pump, thereby supplying the fuel to an injector of the engine 2. The engine 2 may be a gasoline engine, or a diesel engine, for example.

The high pressure pump (fuel injection pump) 10 includes a housing 12, a compressive portion 30, a valve portion 50, and a solenoid portion (electromagnetic portion) 70.

The housing 12 is constructed of a housing body 14, to which a housing cover 16, a fuel inlet 18, and a fuel outlet (not shown) are screwed, for example. The housing body 14 is formed of a magnetic material such as ferritic stainless steel. The housing body 14 has an inlet passage 20, a valve passage 22, a pump chamber 24, a link passage 25, and a discharge passage 26. The housing body 14 and the housing cover 16 forms a gallery (inlet chamber) 28 therebetween. The inlet passage 20 communicates with the fuel inlet 18. Low pressure fuel is supplied from a fuel tank into the inlet passage 20 through the fuel inlet 18. The gallery 28 communicates with the inlet passage 20 and the valve passage 22, thereby introducing fuel from the inlet passage 20 into the valve passage 22. The valve passage 22 is formed on the side of the engine 2 with respect to the gallery 28. The valve passage 22 communicates with the pump chamber 24 through the link passage 25. The valve passage 22 introduces fuel from the gallery 28 into the pump chamber 24 through the link passage 25 when the valve portion 50 opens. The valve portion 50 is provided to the valve passage 22. The discharge passage 26 communicates the pump chamber 24 with the fuel outlet (not shown). Fuel is pressurized (compressed) in the pump chamber 24, and the fuel is discharged to the injector through the discharge passage 26. The fuel outlet has a check valve that opens when pressure of fuel in the pump chamber 24 becomes equal to or greater than a threshold, i.e., predetermined pressure.

The compressive portion 30 is constructed of a cylinder 32, a plunger 34, a spring seat 36, a plunger spring 38, an oil seal 40, 42, a tappet 44, and the like. The cylinder 32 is formed of a material, which is high in hardness, such as martensitic stainless steel. The cylinder 32 is in a substantially cylindrical shape. The cylinder 32 is fixed to the housing body 14 by interference fit, for example. The plunger 34 is supported by the inner peripheral wall of the cylinder 32 to be substantially coaxial with respect to the cylinder 32, thereby being movable axially back and forth while sliding with respect to the cylinder 32. The plunger 34 has one end surface **34*a* that is exposed to the pump chamber 24, thereby being capable of pressing fuel flowing into the pump chamber 24. The plunger 34 has the other end on the opposite side of the pump chamber 24. The other end of the plunger 34 is fixed to the spring seat 36. The plunger spring 38 is interposed between the spring seat 36 and the housing body 14. The spring seat 36 is biased onto a cam 4 via the tappet 44 by resiliency of the plunger spring 38 in the engine 2. The cam 4 serves as a driving unit. In this structure, rotative force of the cam 4 around a rotation axis R is transferred to reciprocating force, and is transmitted to the plunger 34 via the tappet 44, so that the plunger 34 axially moves back and forth. The oil seal 40 seals between the cylinder 32 and the plunger 34, thereby restricting oil from leaking from the inside of the engine 2 into the inside of the cylinder 32. The oil seal 42 seals between the cylinder 32 and the plunger 34, thereby restricting oil from leaking from the inside of the cylinder 32 into the inside of the engine 2**.

Figure 2:
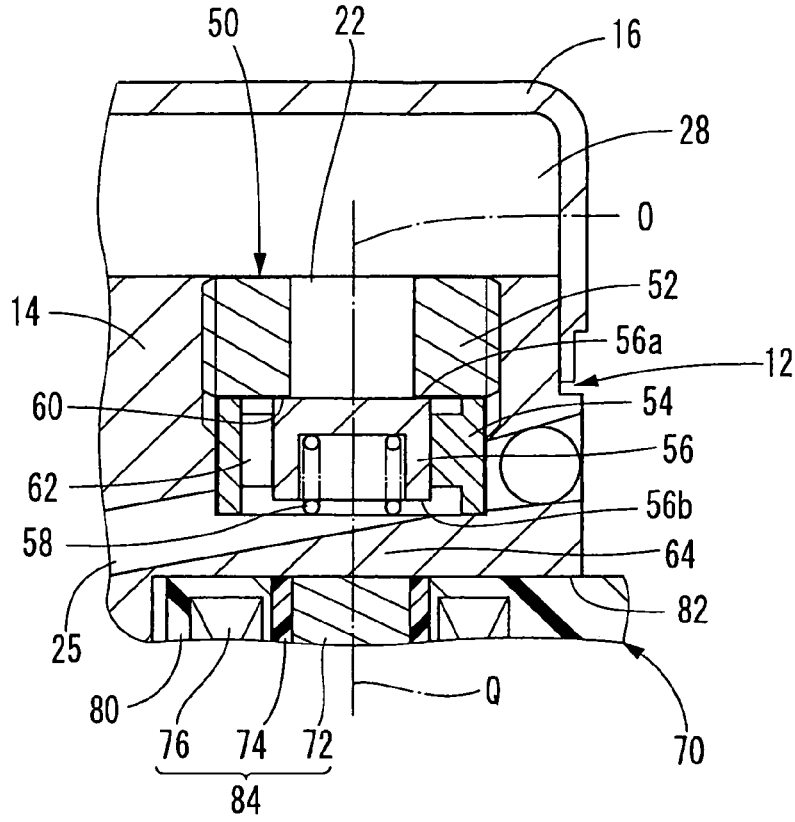
FIG. 2 is a partially cross sectional side view showing a valve portion of the high pressure pump, the valve portion having a valve member being seated onto a seat member, according to the first embodiment.

As shown in FIGS. 1, 2, the valve portion 50 is constructed of a valve seat member 52, a valve guide 54, a valve member (plug) 56, a valve spring 58, and the like. The valve portion 50 is arranged in the valve passage 22. The seat member 52 is in a substantially cylindrical shape, and is screwed into the passage wall of the valve passage 22. The seat member 52 has an end surface on the opposite side of the gallery 28. That is, the end surface of the seat member 52 is arranged on the side of the tappet 44 in the engine 2. This end surface of the seat member 52 forms a seat surface 60. The valve guide 54 is in a substantially cylindrical shape. The valve guide 54 engages with the passage wall of the valve passage 22 on the side of the tappet 44 with respect to the seat member 52. The inner wall of the valve guide 54 has a slit 62 in a predetermined circumferential position. The valve member 56 is formed of a magnetic material, for example. The valve member 56 is in a bottomed substantially cylindrical shape. The valve member 56 is arranged between a stopper core 64 and the seat member 52. The stopper core 64 is a part of the housing body 14. The valve member 56 is supported by the inner peripheral wall of the valve guide 54 to be substantially coaxial with respect to the valve guide 54, so that the valve member 56 is axially movable back and forth while sliding with respect to the valve guide 54. In this embodiment, the valve member 56 has a movable axis O that is displaced with respect to a movable axis P of the plunger 34 substantially in parallel, so that the valve member 56 laps the pump chamber 24 in the radial direction of the plunger 34. The spring 58 is interposed between the inner hole of the valve member 56 and stopper core 64. The spring 58 has resiliency that biases the valve member 56 to the opposite side of the stopper core 64. That is, resiliency of the spring 58 biases the valve member 56 to the side of the seat surface 60.

The seat member 52 has the interior that communicates with the interior of the slit 62 through a gap between a bottom end surface 56*a* of the valve member 56 and the seat surface 60 in the condition where the bottom end surface 56*a* of the valve member 56 is lifted from the seat surface 60 downwardly in FIG. 2. Therefore, fuel flowing from the gallery 28 to the valve passage 22 is introduced into the pump chamber 24 through the interior of the seat member 52, the gap between the seat surface 60 of the seat member 52 and the bottom end surface 56*a* of the valve member 56, the interior of the slit 62, and the link passage 25. The valve member 56 has an opening side end surface 56*b* that abuts onto the stopper core 64, so that the valve member 56 is restricted from further moving in the direction, in which the valve member 56 is lifted from the seat surface 60. The interior of the seat member 52 is blocked from the interior of the slit 62 in the condition where the bottom end surface 56*a* of the valve member 56 is seated onto the seat surface 60 of the seat member 52. Therefore, fuel flowing from the gallery 28 into the valve passage 22 is blocked from the pump chamber 24.

In this structure of the high pressure pump 10, an amount of fuel flowing in to the pump chamber 24 can be controlled by the above operation of the valve member 56.

The solenoid portion 70 is constructed of a stator core 72, a bobbin 74, a coil 76, a connector 78, a terminal 80, and the like. The stator core 72, the bobbin 74, the coil 76, and the connector 78 are partially arranged in an accommodation hole 82 of the housing body 14. The accommodation hole 82 is formed on the side of the tappet 44 with respect to the valve portion 50 and the stopper core 64 in the housing body 14. The accommodation hole 82 is arranged on the radially outer side with respect to the plunger 34 in the housing body 14. The stator core 72 is formed of a magnetic material such as iron, for example, to be in a substantially column shape. The stator core 72 engages with the inner wall of the accommodation hole 82 via both the ends of the stator core 72. The bobbin 74 is formed of resin, for example, to be in a substantially cylindrical shape. The bobbin 74 is engaged with and fixed to the outer wall of the stator core 72. The coil 76 is constructed of a wire such as a copper wire, such that the wire is wound around the outer periphery of the bobbin 74.

The stator core 72, the bobbin 74, and the coil 76 construct a coil portion 84. In this embodiment, the coil portion 84 at least partially laps an axial projection image of the valve member 56. Specifically, the coil portion 84 is arranged in an offset position with respect to the valve member 56 such that a center axis Q of the coil portion 84 is substantially coaxial with respect to the movable axis O of the valve member 56. In this structure, the center axis Q of the coil portion 84 is displaced with respect to the movable axis P of the plunger 34 substantially in parallel. The connector 78 is constructed of the stator core 72, the bobbin 74, and the terminal 80, which are molded of resin. The terminal 80 is taken out of the coil portion 84 to the side of the outer periphery of the housing body 14 on the radially outer side of the plunger 34. The terminal 80 electrically connects with the coil 76, and electrically connects with an external control device, for example, via a cable provided to the connector 78.

When the external control device controls supplying electricity to the coil 76, the coil 76 generates magnetism, so that the stator core 72 and the stopper core 64 are magnetized. Thus, the stopper core 64 and the end surface 56*b* of the valve member 56 generate magnetic attractive force therebetween. This magnetic attractive force is applied to the valve member 56 as magnetic driving force that moves the valve member 56 axially toward the stopper core 64.

Next, an operation of the high pressure pump 10 is described.

Figure 3:
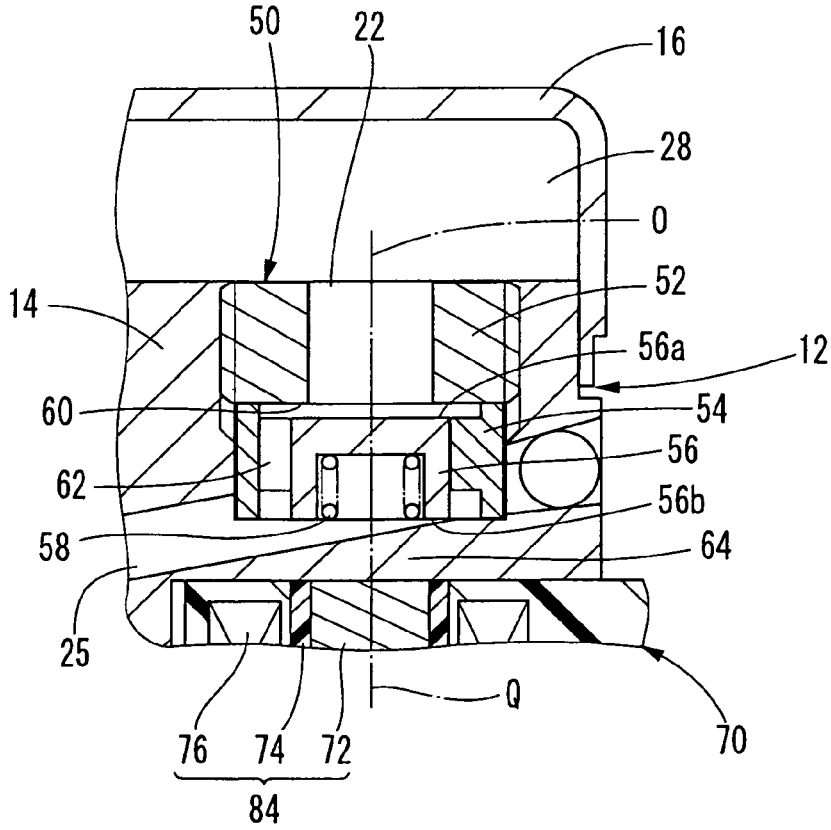
FIG. 3 is a partially cross sectional side view showing the valve portion, in which the valve member is lifted using a coil portion, according to the first embodiment.

In the valve portion 50, pressure is applied to the end surface 56*a* of the valve member 56 as lifting force, which lifts the valve member 56 from the seat surface 60 of the seat member 52. Besides, pressure is applied to the end surface 56*b* of the valve member 56 as seating force, which seats the valve member 56 onto the seat surface 60 of the seat member 52. The plunger 34 moves to the side of the tappet 44 as the cam 4 rotates, so that pressure in the pump chamber 24 decreases. In this condition, difference between the lifting force and the seating force changes. As a result, summation of the seating force applied to the end surface 56*b* and resiliency of the spring 58 decreases with respect to the lifting force applied to the end surface 56*a* of the valve member 56. In this situation, as shown in FIG. 3, the valve member 56 is lifted from the seat surface 60 downwardly in FIG. 3, and abuts onto the stopper core 64, so that fuel flows from the gallery 28 into the valve passage 22. After the valve member 56 abuts onto the stopper core 64, electricity supply to the coil 76 is started before the plunger 34 moves to a limit movable position on the side of the tappet 44. Thus, the valve member 56 and the stopper core 64 generate magnetic attractive force therebetween, so that the valve member 56 maintains abutting onto the stopper core 64. In this condition, fuel maintains flowing into the pump chamber 24.

The plunger 34 reaches the limit movable position on the side of the tappet 44, subsequently, the plunger 34 starts moving toward the pump chamber 24 upwardly in FIG. 1. The coil 76 is maintained being supplied with electricity until a predetermined timing, in which the plunger 34 reaches the limit movable position on the side of the pump chamber 24 while the plunger 34 moves toward the pump chamber 24 upwardly in FIG. 1. The check valve in the fuel outlet restricts fuel from being discharged into the injector in a period from the plunger 34 starts moving to the side of the pump chamber 24 upwardly in FIG. 1 substantially until supplying electricity to the coil 76 stops. In this condition, fuel in the pump chamber 24 is discharged into the gallery 28 through the link passage 25, the interior of the slit 62, the gap between the seat surface 60 of the seat member 52 and the end surface 56*a* of the valve member 56, the interior of the seat member 52, and the valve passage 22.

When supplying electricity to the coil 76 is stopped, the valve member 56 and the stopper core 64 stop generating magnetic attractive force therebetween. In this condition, the seating force, which is pressure applied to the end surface 56*b* of the valve member 56, substantially coincides with pressure of fuel in the pump chamber 24. Summation of force of this seating force applied to the end surface 56*b* of the valve member 56 and resiliency of the spring 58 becomes greater than the lifting force, which is pressure applied to the end surface 56*a* of the valve member 56. Thus, as referred to FIG. 1, the valve member 56 is lifted from the stopper core 64, and is seated onto the seat surface 60, so that fuel in the pump chamber 24 is restricted from being discharged into the gallery 28.

When the plunger 34 further moves to the movable limit position on the side of the pump chamber 24 upwardly in FIG. 1 after the valve member 56 is seated onto the seat surface 60, the plunger 34 compresses fuel in the pump chamber 24. In this condition, when pressure of fuel in the pump chamber 24 becomes equal to or greater than set pressure of the check valve in the fuel outlet, the check valve opens, so that fuel pressurized in the pump chamber 24 is discharged into the injector. Therefore, an amount of fuel discharged from the high pressure pump 10 can be controlled by adjusting the period, in which supplying electricity to the coil 76 is stopped.

In this embodiment, the movable axis O of the valve member 56 is displaced from the movable axis P of the plunger 34 substantially in parallel, so that the valve member 56 is offset relative to the plunger 34 in the radial direction thereof. Thus, the length of the high pressure pump 10 can be reduced with respect to the axial direction of the plunger 34. Furthermore, the movable axis O of the valve member 56 is displaced from the movable axis P of the plunger 34 substantially in parallel. In this structure, the valve member 56 can be extend substantially in the axial direction of the plunger 34. Therefore, the length of the high pressure pump 10 becomes small with respect to the radial direction of the plunger 34, compared with a structure, in which the valve member 56 extends substantially perpendicularly to the movable axis P of the plunger 34.

In this embodiment, the coil portion 84 at least laps the projection image of the valve member 56 in the axial direction of the valve member 56. The coil portion 84 laps the projection image of the valve member 56 on the radially outer side of the plunger 34. In this structure, even when the plunger 34 and the valve portion 50 form a dead space in the high pressure valve 10, the coil portion 84 can be efficiently arranged in this dead space. Therefore, the coil portion 84 can be arranged in the high pressure pump 10, while the high pressure pump 10 is restricted from being enlarged in dimensions in either the axial direction of the plunger 34 and the radial direction of the plunger 34.

Furthermore, the plunger 34 is arranged on the side of the tappet 44 with respect to the pump chamber 24. The coil portion 84 is arranged on the radially outer side of the plunger 34. The coil portion 84 is arranged on the side of the tappet 44 with respect to the valve portion 50. In this structure, the link passage 25, which communicate the valve passage 22 with the pump chamber 24, need not be arranged between the plunger 34 and the coil portion 84, so that the high pressure pump 10 can be restricted from being jumboized in the radial direction of the plunger 34. In addition, the coil portion 84 may be arranged in an offset manner with respect to the axial direction of the valve member 56 in the housing body 14. That is, the axial direction of the coil portion 84 may be displaced with respect to the axial direction of the valve member 56 in the housing body 14.

The terminal 80, which electrically connects the coil portion 84 with an external control device, is arranged on the side of the outer periphery of the housing body 14 on the radially outer side of the plunger 34. The terminal 80 may extend in a substantially radial direction of the housing body 14. Therefore, the terminal 80 can be taken out of the housing body 14 while the high pressure pump 10 is restricted from being elongated in the axial direction of the plunger 34.

Furthermore, in this embodiment, the center axis Q of the coil portion 84 is arranged substantially coaxially with respect to the movable axis O of the valve member 56, so that the coil portion 84 is capable of generating magnetic attractive force substantially uniformly in the circumferential direction of the valve member 56. Thus, the valve member 56 is capable of smoothly moving axially in the valve guide 54.

Furthermore, in this embodiment, the valve portion 50 is arranged in the valve passage 22 on the side of the tappet 44 with respect to the gallery 28. The coil portion 84 is arranged on the side of the tappet 44 with respect to both the valve passage 22 and the valve portion 50. In short, the coil portion 84 is arranged on a substantially opposite side of the gallery 28 with respect to both the valve passage 22 and the valve portion 50. In this structure, the coil portion 84 can be readily sealed relative to both the gallery 28 and the valve passage 22 using the stopper core 64 of the housing body 14. Therefore, manufacturing cost for the high pressure pump 10 can be reduced.

In the above structure, the gallery 28, the valve passage 22, and the link passage 25 serve as a fuel passage. The gallery 28 serves as an upstream passage.

Second Embodiment

Figure 4:
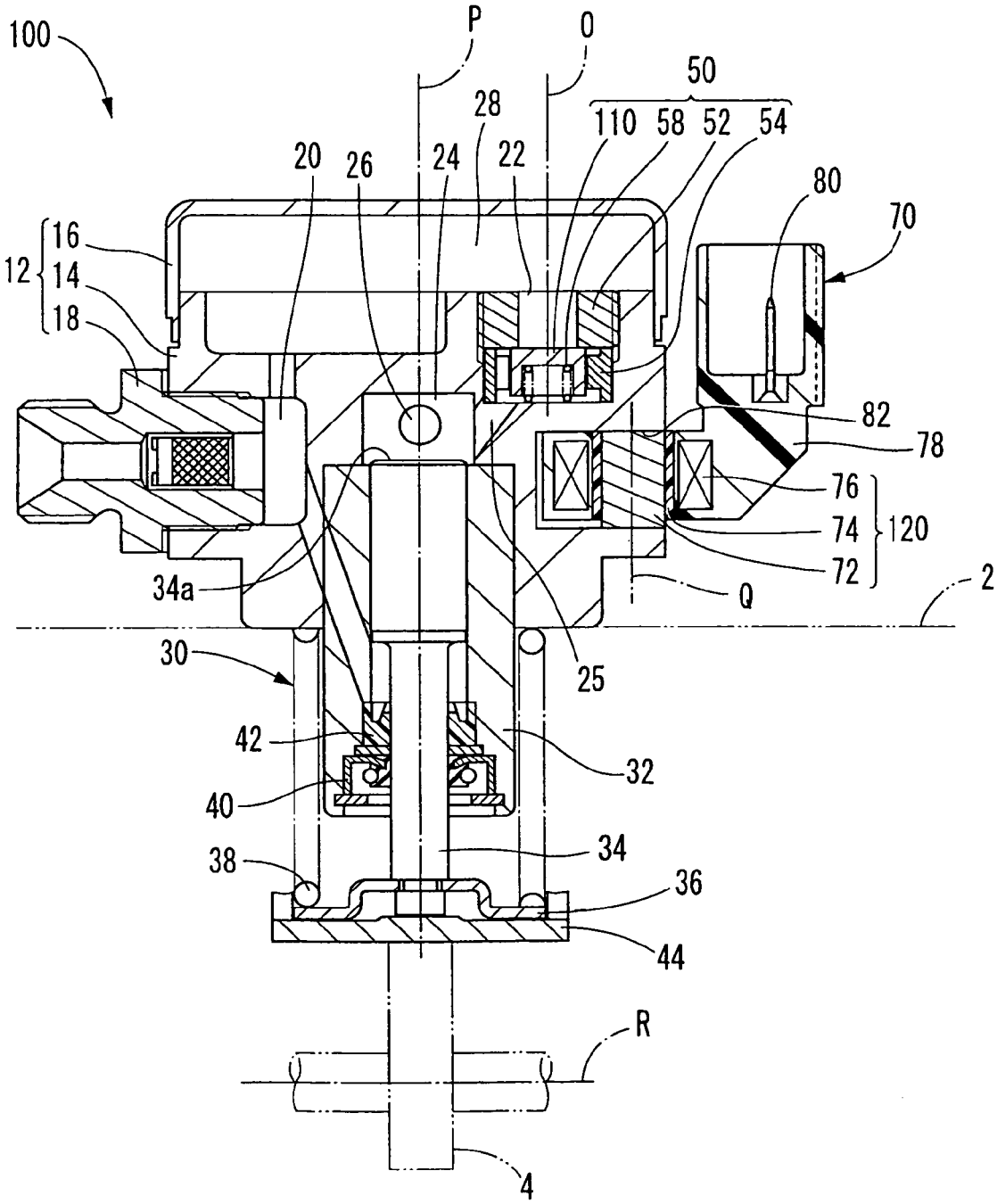
FIG. 4 is a partially cross sectional side view showing a high pressure pump according to a second embodiment of the present invention.

This second embodiment is a variation of the first embodiment. As shown in FIG. 4, a valve member 110 has a movable axis O that is displaced from the center axis Q of the coil portion 120 substantially in parallel in a high pressure pump 100. In this structure, the projection image of the valve member 110 axially laps both the coil portion 120 and the cylinder 32. Therefore, the high pressure pump 100 is downsized in the radial direction of the plunger 34, compared with the structure of the high pressure pump 10 in the fist embodiment.

In the above first and second embodiments, the valve member 56, 110 may be arranged on the side of the tappet 44 with respect to the coil portion 84, 120. In this structure, the link passage 25 may be arranged between the plunger 34 and the coil portion 84, 120, so that the link passage 25 communicates the valve passage 22 with the pump chamber 24.

Third Embodiment

As shown in FIGS. 5 to 8, a high pressure pump 510 is a fuel pump that supplies fuel into an injector of an internal combustion engine such as a diesel engine and a gasoline engine, for example.

The high pressure pump 510 includes a housing member 512, a housing cover 516, a plunger 520, a piping joint 530, a control valve 540, a discharge valve 560, a relief valve 570, and the like.

Figure 7:
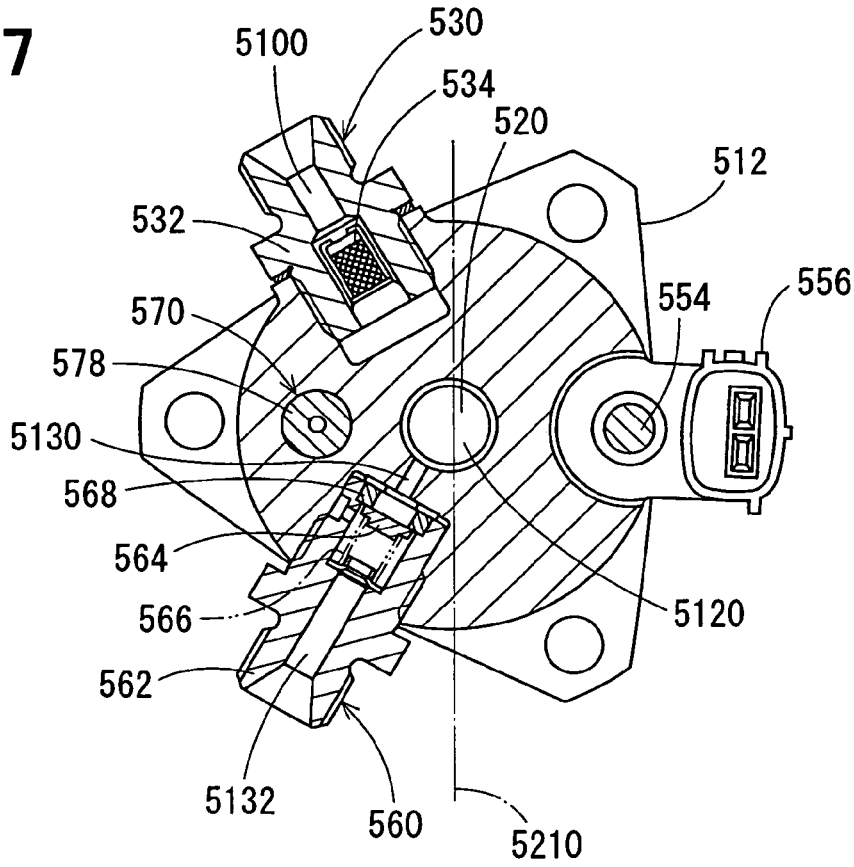
FIG. 7 is a cross sectional view taken along the line VII-VII in FIG. 5.
Figure 8:
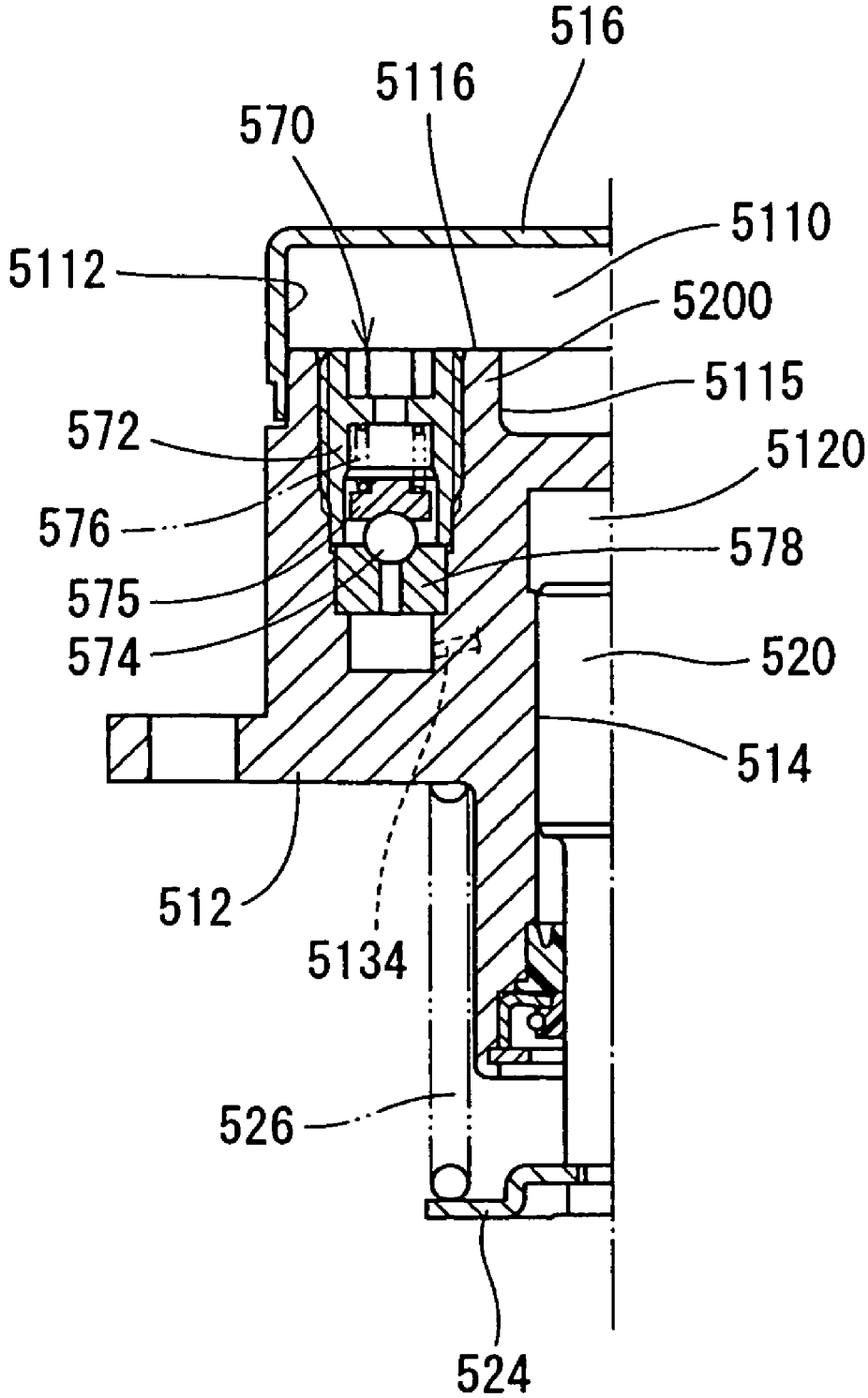
FIG. 8 is a partially cross sectional side view showing a relief valve of the high pressure pump, according to the third embodiment.

The housing body 512 and the housing cover 516 construct a pump housing. The housing body 512 is formed of martensitic stainless steel, for example. The housing body 512 has a portion, which slides with respect to the plunger 520. This portion of the housing body 512 is hardened by induction hardening, for example, so that the portion of the housing body 512 forms a cylinder 514, in which the plunger 520 is movable back and forth. The housing body 512 has an introduction passage 5102, an inlet passage 5118, a compression chamber 5120, an escape passage 5122, a discharge passage 5130 (FIG. 7), and a discharge passage 5134 (FIG. 8). The housing body 512 and the housing cover 516 form an inlet chamber 5110 therebetween.

The inlet chamber 5110 is formed on the substantially opposite side of the compression chamber 5120 with respect to the axial direction of the plunger 520. The inlet chamber 5110 expands outwardly in the radial direction of the compression chamber 5120. The inlet chamber 5110 has an outer circumferential periphery 5112 on the opposite side of the compression chamber 5120. The outer circumferential periphery 5112 is in a substantially circular shape. The inlet chamber 5110 has an outer circumferential periphery 5114 on the side of the compression chamber 5120.

Figure 6:
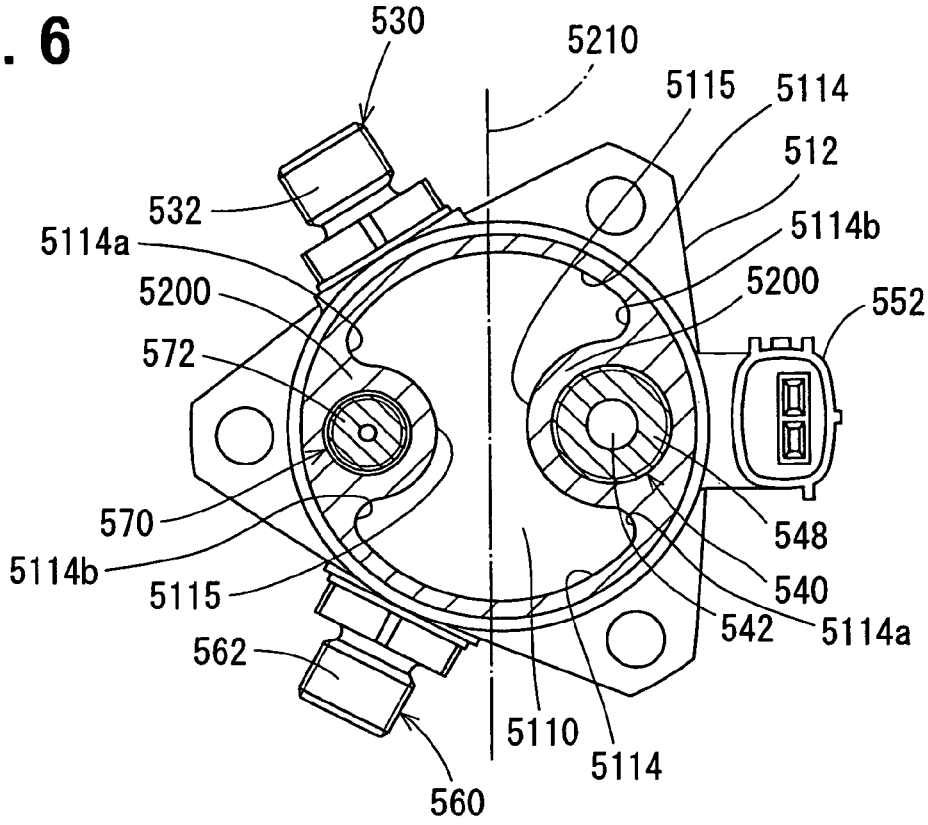
FIG. 6 is a cross sectional view taken along the line VI-VI in FIG. 5.

As shown in FIG. 6, recessions 5115 are formed in radially both sides of the outer circumferential periphery 5114. The outer circumferential periphery 5114 excluding the recessions 5115 is in a substantially arc shape. The recessions 5115 are arranged on the radially inner side of arc portions, which are defined by circumferentially extending portions of the outer circumferential periphery 5114 excluding the recessions 5115. That is, the recessions 5115 respectively form discontinuous portions (defining portions) with respect to the portions of the outer circumferential periphery 5114 in the arc shapes. The inlet chamber 5110 has a step 5116 (FIGS. 1, 4) in the axial direction thereof, so that a recession 5115 is formed in the inlet chamber 5110. The recessions 5115 and the step 5116 form a recessed portion, which is inwardly dented in the inlet chamber 5110.

More specifically, as referred to FIG. 6, the inlet chamber 5110 has two outer circumferential peripheries 5114. Each of the outer circumferential peripheries 5114 has a first end 5114*a* and a second end 5114*b*. The first end 5114*a* extends to the second end 5114*b* in each of the outer circumferential peripheries 5114. The first end 5114*a* of one of the outer circumferential peripheries 5114 extends to the second end 5114*b* of the other of the outer circumferential peripheries 5114 to define the defining portions (discontinuous portions) 5115. The one of the outer circumferential peripheries 5114 is circumferentially adjacent to the other of the outer circumferential peripheries 5114. Each of the defining portions 5115 defines the remaining space 5200 in the pump housing 512, 516. The remaining space 5200 is located on the outer side of the defining portion 5115 with respect to the circumferential direction of the outer circumferential periphery 5114.

Each of the recessions 5115 has a remaining space 5200 on the outer side in the housing body 512 with respect to the radial direction of the inlet chamber 5110. The control valve 540 and the relief valve 570 are arranged in the remaining spaces 5200 in the housing body 512. The piping joint 530 and the discharge valve 560 are arranged at spaces of the housing body 512. These spaces of the housing body 512 are formed on the side of the outer circumferential periphery of the compression chamber 5120. These spaces of the housing body 512 are formed on the side of the compression chamber 5120 with respect to the inlet chamber 5110. The piping joint 530 serves as an inlet member. The discharge valve 560 serves as an outlet member. The relief valve 570 is arranged in a space, which is formed between the pipe joint 530 and the discharge valve 560 in the circumferential direction of the inlet chamber 5110. As shown in FIGS. 6, 7, the pipe joint 530, the discharge valve 560, and the relief valve 570 are arranged on the opposite side of the control valve 540 with respect to an imaginary plane 5210 including a center axis of the plunger 520.

Next, the components of the high pressure pump 510 is described. The high pressure pump 510 is mounted to the housing body 512. As referred to FIG. 5, the plunger 520 is capable of reciprocating in the cylinder 514 of the housing body 512. The compression chamber 5120 is formed on one end side in the movable direction of the plunger 520. The plunger 520 has a head 522 on the other end side of the plunger 520 downwardly in FIG. 5. The head 522 connects with a spring seat member 524. The spring seat member 524 and the housing body 512 interpose a spring 526 therebetween. Resiliency of the spring 526 biases the spring seat member 524 onto the bottom inner wall of a tappet (not shown). The tappet has a bottom outer wall that slides with respect to a cam (not shown) as the cam rotates, so that the plunger 520 moves back and forth.

The outer circumferential periphery of the plunger 520 on the side of the head 522 is sealed with respect to the inner circumferential periphery of the housing body 512, which accommodates the plunger 520, via an oil seal 528. The oil seal 528 restricts oil from intruding into the pressurizing camber 5120 from the interior of the engine. Furthermore, the oil seal 528 restricts fuel from leaking into the engine from the pressurizing camber 5120.

Fuel, which leaks from the sliding portion between the plunger 520 and the cylinder 514 into the side of the oil seal 528, returns into the introduction passage 5102, which is on the low pressure side, through the escape passage 5122. In this structure, the oil seal 528 is restricted from being applied with high pressure of fuel.

The pipe joint 530 has a joint body 532 that is screwed with the housing body 512, so that the pipe joint 530 is assembled to the introduction passage 5102. The joint body 532 of the pipe joint 530 has a fuel passage 5100 that communicates with the introduction passage 5102. A fuel filter 534 is provided to the fuel passage 5100.

The control valve 540 includes a valve member 542, a valve guide 544, a spring 546, a seat member 548, a solenoid 550, and the like. The valve member 542 is formed of a magnetic material. Alternatively, the valve member 542 is formed of a magnetic material that is coated with a non-magnetic material. The valve member 542 is in a substantially cup shape. The valve member 542 is movable back and forth in the valve guide 544. The spring 546 biases the valve member 542 to the seat member 548, which is provided on the side of the inlet chamber 5110 with respect to the valve member 542. When the valve member 542 is seated onto the seat member 548, the inlet chamber 5110 is blocked from the inlet passage 5118.

The solenoid 550 of the control valve 540 is formed such that a center core 554 and a coil 556 are insert formed in a resinous portion 552. The center core 554 and a part of the coil 556 engage with a recession 518 of the housing body 512. The recession 518 is formed around the outer circumferential periphery of the compression chamber 5120. The recession 518 is arranged on the opposite side of the inlet chamber 5110 with respect to the valve member 542. When the coil 556 is supplied with electricity, the housing body 512 and the valve member 542 generate magnetic attractive force therebetween. The housing body 512 is on the substantially opposite side of the seat member 548 with respect to the valve member 542.

As referred to FIG. 7, the discharge valve 560 has a body 562 that is screwed to the housing body 512, so that the discharge valve 560 is assembled into the discharge passage 5130. The body 562 of the discharge valve 560 has a fuel passage 5132 that accommodates a valve member 564, a spring 566, and a seat member 568. The seat member 568 is arranged on the side of the compression chamber 5120 with respect to the valve member 564. The spring 566 biases the valve member 564 to the seat member 568. When pressure of fuel in the compression chamber 5120 becomes equal to or greater than predetermined pressure, the valve member 564 is lifted from the seat member 568 against resiliency of the spring 566. Thus, fuel in the compression chamber 5120 is discharged from the high pressure pump 510 after passing through the discharge passage 5130 and the fuel passage 5132. Fuel discharged from the high pressure pump 510 is supplied to a fuel rail such as a common rail, in which the pressurized fuel is accumulated. The fuel accumulated in the fuel rail is supplied into the injector.

As referred to FIGS. 6, 7, the relief valve 570 is arranged in the space, which includes the remaining spaces 5200, formed circumferentially between the pipe joint 530 and the discharge valve 560. In this structure, the relief valve 570 is entirely accommodated in the housing body 512. As referred to FIG. 8, the body 572 of the relief valve 570 is screwed with the housing body 512 such that the body 572 of the relief valve 570 and the housing body 512 interpose a seat member 578 therebetween, so that the relief valve 570 is assembled to the housing body 512. A ball 574 and a spring seat 575 construct a valve member of the relief valve 570. The spring 576 biases the spring seat 575 and the ball 574 to the seat member 578. The discharge passage 5134 communicates with the down stream of the valve member 564 of the discharge valve 560 (FIG. 7), so that pressure of fuel in the discharge passage 5134 is applied in the direction, in which the ball 574 is lifted from the seat member 578. When pressure of fuel in the downstream of the valve member 564 becomes equal to or greater than predetermined pressure, the ball 575 is lifted from the seat member 578 against resiliency of the spring 576, so that fuel is discharged from the discharge passage 5134 into the inlet chamber 5110. The set pressure, at which the relief vale 570 opens, is predetermined to be greater than the set pressure, at which the discharge valve 560 opens.

Next, an operation of the high pressure pump 510 is described.

First, an intake stroke is described. Pressure in the inlet chamber 5110, which is in the upstream of the valve member 542, is applied to the valve member 542 from the upstream thereof. Pressure in the compression chamber 5120, which is in the downstream of the valve member 542, is applied to the valve member 542 from the downstream thereof. When the plunger 520 moves in a drawing direction downwardly in FIG. 5, and pressure in the compression chamber 5120 decreases, differential pressure, which is applied from the inlet chamber 5110 and the compression chamber 5120 to the valve member 542, changes. In this condition, seating force is caused by pressure of fuel in the compression chamber 5120 and is applied to the valve member 542 in the direction, in which the valve member 542 is seated onto the seat member 548. In addition, lifting force is caused by pressure of fuel on the side of the inlet chamber 5110 in the direction, in which the valve member 542 is lifted from the seat member 548. When summation of the seating force of the valve member 542 and resiliency of the spring 546 becomes less than the lifting force of the valve member 542, the valve member 542 is lifted from the seat member 548, and abuts onto the housing body 512, which is on the opposite side of the seat member 548 with respect to the valve member 542. Thus, fuel flows into the compression chamber 5120 after passing through the inlet chamber 5110 and the inlet passage 5118.

The coil 556 is supplied with electricity in the condition where the valve member 542 makes contact with the housing body 512 before the plunger 520 reaches to the bottom dead center thereof. Therefore, magnetic attractive force generated using the coil 556 may be small for maintaining the valve member 542 making contact with the housing body 512 to open the control valve 540.

Next, a return stroke is described. The electricity supplied to the coil 556 is maintained, even when the plunger 530 starts moving in a pressurizing direction upwardly in FIG. 5 from the bottom dead center thereof to the top dead center thereof. In this condition, the magnetic force is applied between the housing body 512 and the valve member 542, so that the valve member 542 continues abutting onto the housing body 512, thereby maintaining the control valve 540 opening. Thus, fuel, which is pressurized in the compression chamber 5120 as the plunger 520 upwardly moves, returns into the inlet chamber 5110 from the control valve 540 after passing through the inlet passage 5118.

Next, a pressurizing stroke is described. When supplying electricity to the coil 556 stops in the return stroke, the coil 556 stops generating magnetic force applied between the valve member 542 and the housing body 512. In this condition, summation of the seating force, which is applied to the valve member 542 from the compression chamber 5120 to the seat member 548, and resilience of the spring 546 becomes greater than the lifting force, which is applied to the valve member 542 from the inlet chamber 5110. Thus, the valve member 542 is seated onto the seat member 548, so that the inlet chamber 5110 is blocked from the inlet passage 5118. In this condition, when the plunger 520 further moves in the pressurizing direction upwardly in FIG. 5 to the top dead center thereof, fuel in the compression chamber 5120 is pressurized, thereby increasing in pressure. When pressure of fuel in the compression chamber 5120 becomes greater than predetermined pressure, the valve member 564 of the discharge valve 560 is lifted from the seat member 568 against resiliency of the spring 566 in the discharge valve 560, so that the discharge valve 560 opens. Thus, fuel pressurized in the compression chamber 5120 is discharged from the discharge valve 560 through the discharge passage 5130. The fuel discharged from the discharge valve 560 is supplied to the fuel rail (not shown), and is accumulated. The accumulated fuel is supplied into the injector. When pressure of fuel accumulated in the fuel rail becomes equal to or greater than predetermined pressure, the ball 574 of the relief valve 570 is lifted from the seat member 578. Therefore, fuel passing through the fuel passage 5132 (FIG. 7) of the discharge valve 560 returns into the inlet chamber 5110 through the discharge passage 5134 (FIG. 8) and the relief valve 570.

The above intake stroke, return stroke, and pressurizing stoke are repeated, so that the high pressure pump 510 pumps fuel. The timing of supplying electricity to the coil 556 of the control valve 540 is controlled, so that the amount of fuel discharged from the high pressure pump 510 is restricted.

In this embodiment, the inlet chamber 5110 is dented to the side of the compression chamber 5120. One of the remaining space 5200 formed in the housing body 512 accommodates the valve member 542 of the control valve 540.

The coil 556 of the control valve 540 is arranged in the space on the opposite side of the inlet chamber 5110 with respect to the valve member 542. The coil 556 is arranged in the space on the side of the outer circumferential periphery of the compression chamber 5120. The control valve 540 includes the solenoid 550, therefore the control valve 540 needs a large accommodation space. However, in this structure, the control valve 540 can be provided in the housing body 512 efficiently using the space of the housing body 512.

The pipe joint 530 and the discharge valve 560 are arranged around the compression chamber 5120. The pipe joint 530 and the discharge valve 560 are arranged on the side of the compression chamber 5120 with respect to the inlet chamber 5110. The relief valve 570 is arranged in the space of the housing body 512. This space of the relief valve 570 is formed circumferentially between the pipe joint 530 and the discharge valve 560 in the housing body 512.

Furthermore, the pipe joint 530, the discharge valve 560, and the relief valve 570 are arranged on one side with respect to the imaginary plane 5210 including a center axis of the plunger 520. The control valve 540 is arranged on the opposite side of the pipe joint 530, the discharge valve 560, and the relief valve 570 with respect to the imaginary plane 5210. Each of the pipe joint 530, the discharge valve 560, and the relief valve 570 has a simple structure, thereby needing a mounting space, which is smaller than a mounting space needed for the control valve 540. In this structure, the pipe joint 530, the discharge valve 560, and the relief valve 570 are consolidated to the one side with respect to the imaginary plane 5210. The control valve 540, which needs a large accommodating space due to having the solenoid 550, is arranged on the other side with respect to the imaginary plane 5210.

In the above structure, the space in the housing body 512 is efficiently used, so that components of the high pressure pump 510 are restricted from excessively protruding outwardly from the high pressure pump 510. As a result, the high pressure pump 510 can be downsized.

The control valve 540 communicates the inlet chamber 5110 with the compression chamber 5120 and blocks the inlet chamber 5110 from the compression chamber 5120. The relief valve 570 returns fuel into the inlet chamber 5110 for controlling pressure of fuel on the downstream side of the discharge valve 560. The control valve 540 and the relief valve 570 are arranged respectively in the remaining spaces 5200, which are in the vicinity of the inlet chamber 5110. In this structure, a fuel passage communicating the control valve 540 with the inlet chamber 5110 can be reduced in length, or can be omitted. In addition, a fuel passage communicating the relief valve 570 with the inlet chamber 5110 can be reduced in length, or can be omitted. Thus, fuel passage can be readily formed in the high pressure pump 510.

Furthermore, an amount of protrusion of components excessively outwardly protruding from the high pressure pump 510 can be reduced. The components can be restricted from interfering with respect to other components around the high pressure pump 510 when the high pressure pump 510 is mounted. Therefore, the high pressure pump 510 can be readily mounted.

Fourth and Fifth Embodiments

Figure 5:
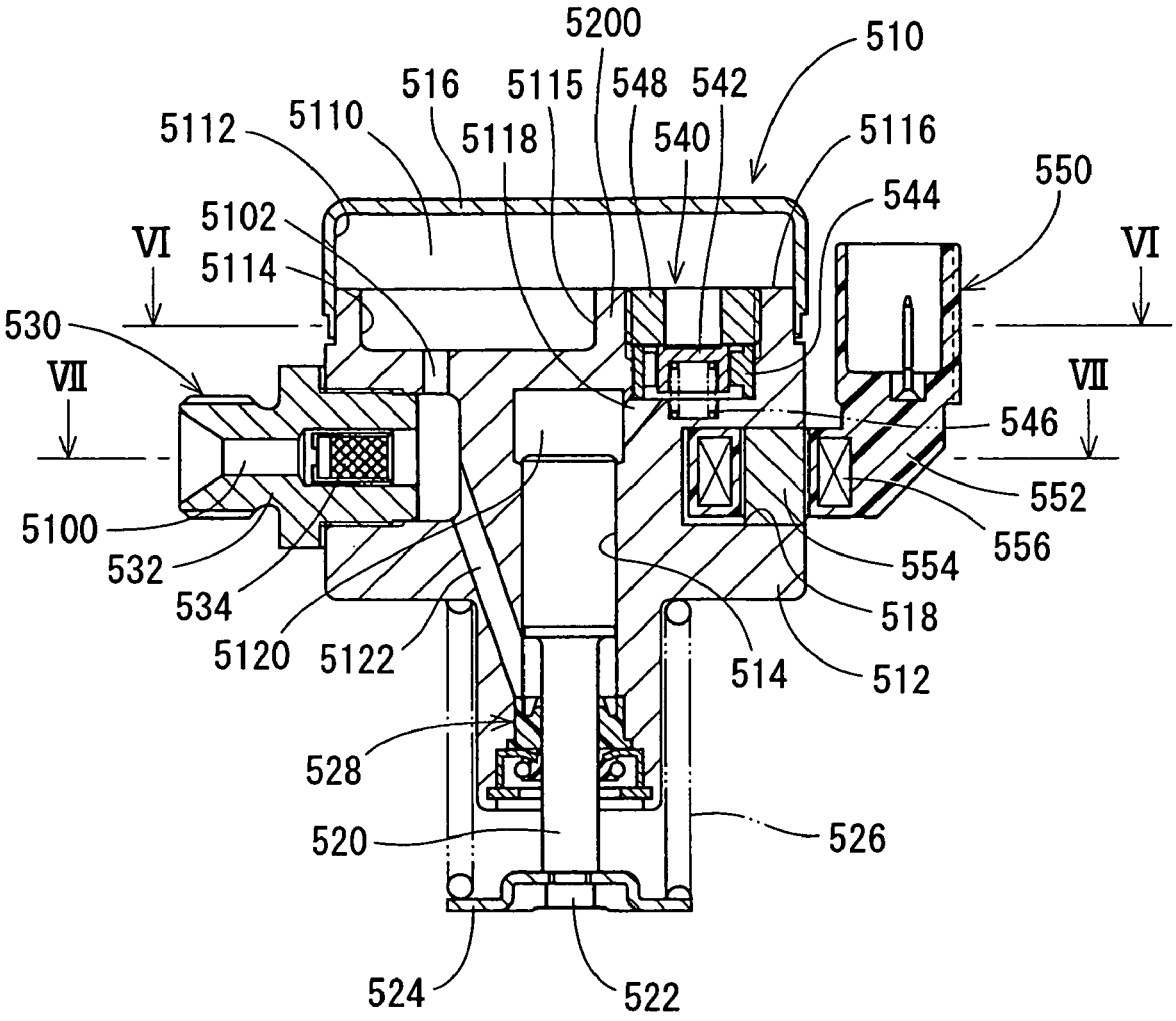
FIG. 5 is a partially cross sectional side view showing a high pressure pump, according to a third embodiment of the present invention.
Figure 9:
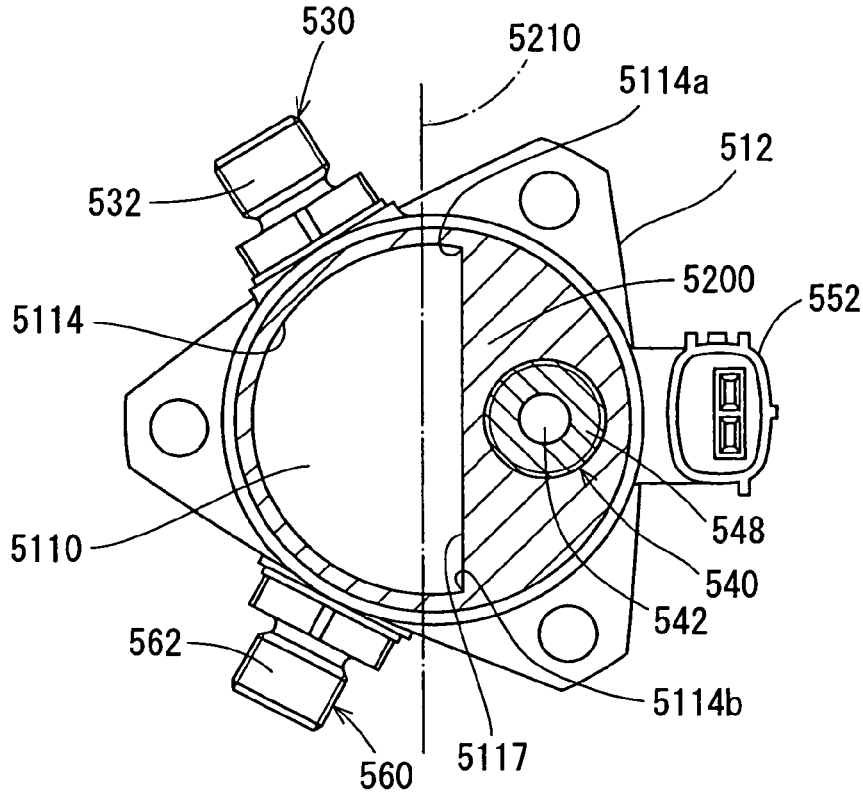
FIG. 9 is a cross sectional view showing a high pressure pump according to a fourth embodiment of the present invention.

The cross sectional view shown in FIG. 9 is taken along a line, which is the same as the line VI-VI in FIG. 5. As shown in FIG. 9, in the fourth embodiment, a linear portion 5117 is formed in the outer circumferential periphery 5114 of the inlet chamber 5110. This linear portion 5117 serves as a discontinuous portion (defining portion). The control valve 540 is arranged on the side of the outer circumferential periphery relative to the linear portion 5117.

More specifically, as referred to FIG. 9, the inlet chamber 5110 has the outer circumferential periphery 5114 that extends from the first end 5114*a* thereof to the second end 5114*b* thereof. The first end 5114*a* extends to the second end 5114*b* to form the defining portion (discontinuous portion) 5117 that defines the remaining space 5200. The remaining space 5200 is located on the outer side of the defining portion 5117 with respect to the circumferential direction of the outer circumferential periphery 5114.

Figure 10:
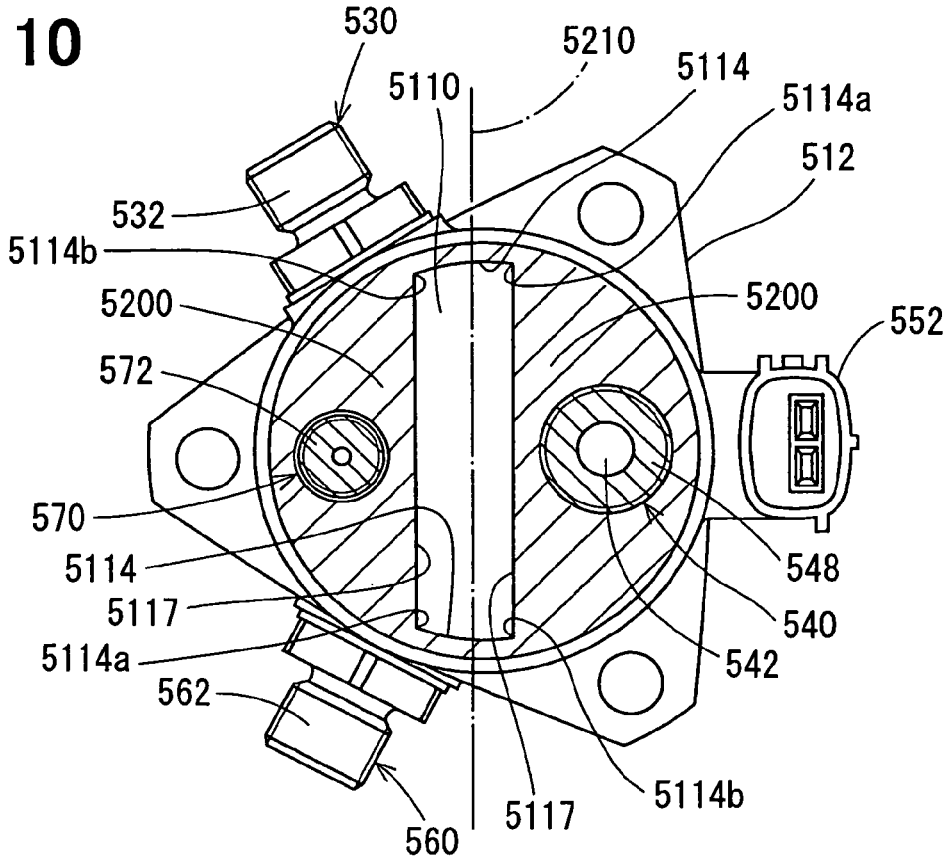
FIG. 10 is a cross sectional view showing a high pressure pump according to a fifth embodiment of the present invention.

The cross sectional view shown in FIG. 10 is taken along a line, which is the same as the line VII-VII in FIG. 5. As shown in FIG. 10, in the fifth embodiment, two linear portions 5117 are formed on both sides of the inlet chamber 5110 with respect to the circumferential direction of the outer circumferential periphery 5114. Each of the control valve 540 and the relief valve 570 is arranged on the side of the outer circumferential periphery relative to the linear portions 5117.

In the above fourth and fifth embodiments, the outer circumferential periphery 5114 excluding each linear portion 5117 is in a substantially arc shape. The linear portion 5117 is located on the radially inner side of an arc shaped portion, which is defined by circumferentially extending the outer circumferential periphery 5114 excluding the linear portion 5117. In this structure, the linear portion 5117 defines a discontinuous portion with respect to the outer circumferential periphery 5114. The liner portion 5117 defines the recessed portion, which is inwardly dented in the inlet chamber 5110.

Sixth Embodiment

Figure 11:
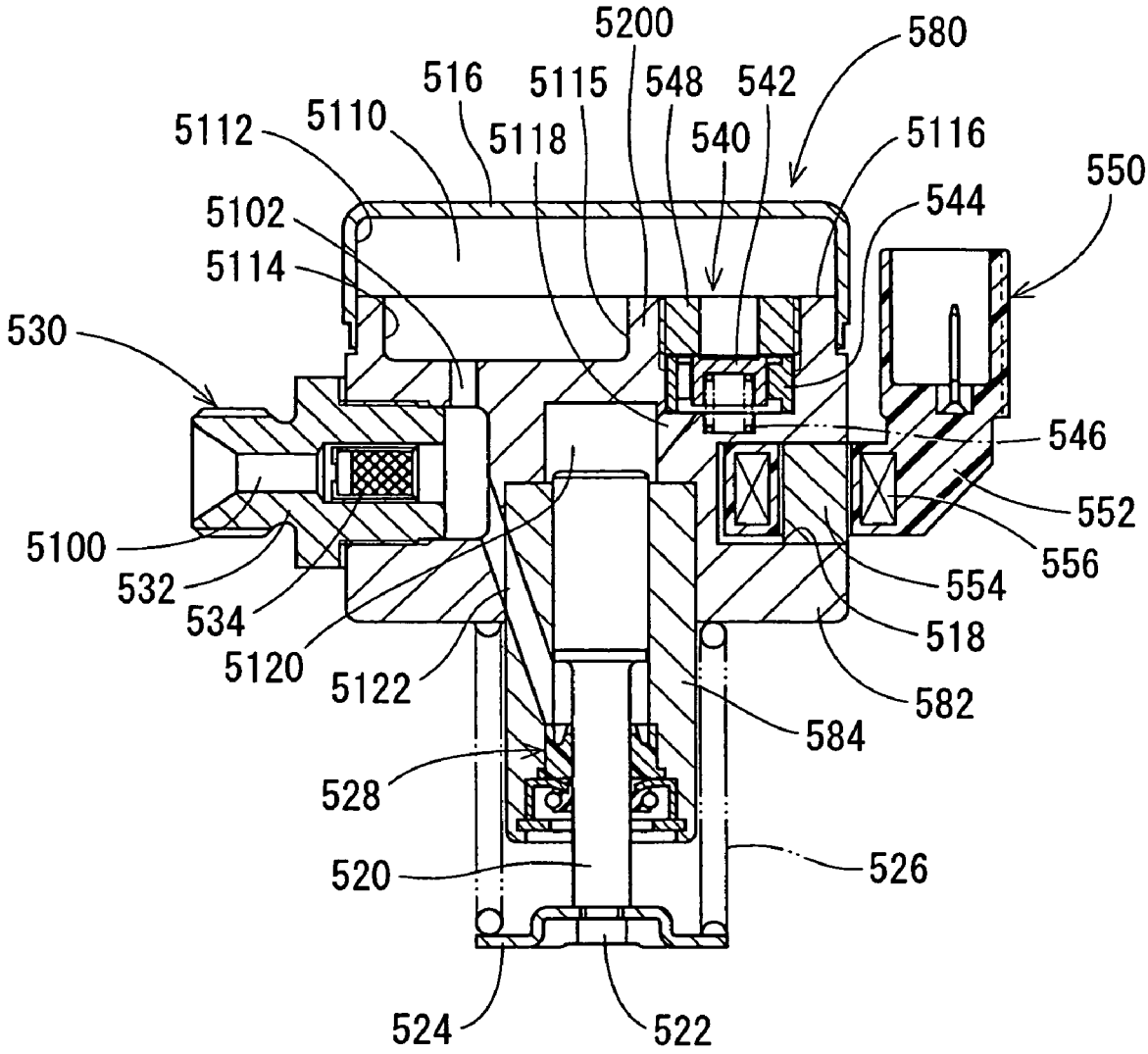
FIG. 11 is a partially cross sectional side view showing a high pressure pump according to a sixth embodiment of the present invention.

As shown in FIG. 11, a housing body 582, a cylinder 584, and the housing cover 516 construct the pump housing of a high pressure pump 580. The housing body 582, the cylinder 584, and the housing cover 516 are individual from each other. The housing body 582 is formed of ferritic stainless steel. The cylinder 584 is formed of martensitic stainless steel.

Other Embodiment

In the third to sixth embodiments, the control valve 540 is arranged in the remaining space 5200 formed in the housing body as a component of the high pressure pump. Alternatively, the control valve 540 and the relief valve 570 are arranged in the remaining spaces 5200 formed in the housing body as components of the high pressure pump. However, the pipe joint 530 and the discharge valve 560 may be arranged in at least one of the remaining spaces 5200, in addition to the control valve 540 and the relief valve 570. Alternatively, the pipe joint 530 and the discharge valve 560 may be arranged in at least one of the remaining spaces 5200 instead of the control valve 540 and the relief valve 570.

In the third to sixth embodiments, the recessions 5115 are formed in the inlet chamber 5110, alternatively, at least one of the linear portions 5117 is formed in the outer circumferential periphery 5114 of the inlet chamber 5110 on the side of the compression chamber as at least one of the discontinuous portions. Each of the remaining spaces 5200 is formed in the housing body on the circumferentially outer side of the recession 5115 or the linear portion 5117. However, the remaining space 5200 is not limited to the above structure. At least one of the recession 5115 and the linear portions 5117 may be formed on the opposite side of the inlet chamber 5110 with respect to the compression chamber 5120. The remaining space may be formed on the radially outer side of the recession 5115 or the linear portion 5117. Alternatively, the recession 5115 or the linear portion 5117 may be formed on the lateral side of the inlet chamber 5110 lengthwise throughout the inlet chamber 5110. The remaining space may be formed on the radially outer side of at least one of the recession 5115 and the linear portions 5117.

A recession may be formed in one of the upper side of the inlet chamber and the lower side of the inlet chamber, instead of being formed in the lateral side of the inlet chamber. A remaining space can be formed in the outside of this recession. The shape of the discontinuous portion in the outer circumferential periphery of the inlet chamber may be in a substantially arc shape, which has the curvature smaller than the curvature of a part of the outer circumferential periphery of the discontinuous portion when the outer circumferential periphery of the discontinuous portion is at least partially in a substantially arc shape. Similar effect can be produced when discontinuous portion is located on the radially inner side of a portion circumferentially extended from the outer circumferential periphery excluding the discontinuous portion.

The outer circumferential periphery of the inlet chamber may be entirely formed of linear portions, and the linear portions may be defined as the discontinuous portion. In this case, the outer circumferential periphery is in a polygonal shape.

Fluid, which is pumped using the high pressure pump, is not limited to fuel. The high pressure pump can pump any kinds of fluid such as gas, two-phased fluid of vapor and liquid, and liquid.

The above structures of the embodiments can be combined as appropriate.

In the above embodiments, the sealing structure is used in the flowmeter. However, the sealing structure is not limited to be used in a flowmeter. The sealing structure can be used for any other accommodating structures.

Various modifications and alternations may be diversely made to the above embodiments without departing from the spirit of the present invention.

What is claimed is:

1. A high pressure pump comprising:

an inlet member;

a pump housing that has an inlet chamber and a compression chamber, fluid being drawn from the inlet member into the compression chamber through the inlet chamber, fluid being pressurized in the compression chamber;

an outlet member, through which fluid flows from the compression chamber; and a plunger that is movable in the pump housing for pressurizing fluid in the compression chamber, wherein the inlet chamber has an outer circumferential periphery that includes a discontinuous portion with respect to a circumferential direction of the outer circumferential periphery, and the pump housing has a space on an outer side of the discontinuous portion with respect to the circumferential direction of the outer circumferential periphery, the high pressure pump further comprising:

at least one component that is at least partially accommodated in the space.

2. The high pressure pump according to claim 1, wherein the discontinuous portion is a linear portion.

3. The high pressure pump according to claim 2, wherein the linear portion substantially linearly extends from one end of the outer circumferential periphery to an other end of the outer circumferential periphery.

4. The high pressure pump according to claim 1, wherein the inlet chamber is arranged on a substantially opposite side of the plunger with respect to the compression chamber, and the inlet chamber expands outwardly in a radial direction of the compression chamber.

5. The high pressure pump according to claim 4, wherein the space is arranged on a side of the compression chamber with respect to the inlet chamber.

6. The high pressure pump according to claim 1, wherein the at least one component includes a control valve that is capable of communicating the inlet chamber with the compression chamber and is capable of blocking the inlet chamber from the compression chamber for controlling an amount of fluid flowing from the outlet member.

7. The high pressure pump according to claim 6, wherein the control valve includes a valve member and a coil, the valve member is at least partially accommodated in the space, the valve member is capable of communicating the inlet chamber with the compression chamber and is capable of blocking the inlet chamber from the compression chamber, the coil is capable of generating magnetic attractive force for operating the valve member, the coil is arranged on a substantially opposite side of the inlet chamber with respect to the valve member, and the coil is arranged on an outer side of the compression chamber with respect to a radial direction of the compression chamber.

8. The high pressure pump according to claim 1, wherein the at least one component includes a relief valve that controls pressure of fluid in a downstream of the outlet member.

9. The high pressure pump according to claim 4, wherein the inlet member and the outlet member are arranged on a side of the compression chamber with respect to the inlet chamber.

10. The high pressure pump according to claim 9, wherein the at least one component includes a relief valve that controls pressure of fluid in a downstream of the outlet member, and the relief valve is arranged circumferentially between the inlet member and the outlet member.

11. The high pressure pump according to claim 10, wherein the at least one component includes a control valve that includes a valve member and a coil, the valve member is capable of communicating the inlet chamber with the compression chamber and is capable of blocking the inlet chamber from the compression chamber for controlling an amount of fluid flowing from the outlet member, the coil is capable of generating magnetic attractive force for operating the valve member, and the control valve is arranged on a substantially opposite side of the inlet member, the outlet member, and the relief valve with respect to an imaginary plane including a center axis of the plunger.

12. The high pressure pump according to claim 1, wherein the space is on an outer side of the discontinuous portion with respect to a radial direction of the pump housing.

13. The high pressure pump according to claim 1, wherein the outer circumferential periphery of the inlet chamber extends substantially in a circumferential direction of the outer circumferential periphery excluding the discontinuous portion.

14. A high pressure pump comprising:

an inlet member;

a pump housing that has an inlet chamber and a compression chamber, fluid being drawn from the inlet member into the compression chamber through the inlet chamber, fluid being pressurized in the compression chamber;

an outlet member, through which fluid flows from the compression chamber; and a plunger that is movable in the pump housing for pressurizing fluid in the compression chamber, wherein the inlet chamber has a recessed portion, and the pump housing has a space in an outside of the recessed portion, the high pressure pump further comprising:

at least one component that is at least partially accommodated in the space.

15. The high pressure pump according to claim 14, wherein the inlet chamber is arranged on a substantially opposite side of the plunger with respect to the compression chamber, and the inlet chamber expands outwardly in a radial direction of the compression chamber.

16. The high pressure pump according to claim 15, wherein the space is arranged on a side of the compression chamber with respect to the inlet chamber.

17. The high pressure pump according to claim 14, wherein the at least one component includes a control valve that is capable of communicating the inlet chamber with the compression chamber and is capable of blocking the inlet chamber from the compression chamber for controlling an amount of fluid flowing from the outlet member.

18. The high pressure pump according to claim 17, wherein the control valve includes a valve member and a coil, the valve member is at least partially accommodated in the space, the valve member is capable of communicating the inlet chamber with the compression chamber and is capable of blocking the inlet chamber from the compression chamber, the coil is capable of generating magnetic attractive force for operating the valve member, the coil is arranged on a substantially opposite side of the inlet chamber with respect to the valve member, and the coil is arranged on an outer side of the compression chamber with respect to a radial direction of the compression chamber.

19. The high pressure pump according to claim 14, wherein the at least one component includes a relief valve that controls pressure of fluid in a downstream of the outlet member.

20. The high pressure pump according to claim 15, wherein the inlet member and the outlet member are arranged on a side of the compression chamber with respect to the inlet chamber.

21. The high pressure pump according to claim 20, wherein the at least one component includes a relief valve that controls pressure of fluid in a downstream of the outlet member, and the relief valve is arranged circumferentially between the inlet member and the outlet member.

22. The high pressure pump according to claim 21, wherein the at least one component includes a control valve that includes a valve member and a coil, the valve member is capable of communicating the inlet chamber with the compression chamber and is capable of blocking the inlet chamber from the compression chamber for controlling an amount of fluid flowing from the outlet member, the coil is capable of generating magnetic attractive force for operating the valve member, and the control valve is arranged on a substantially opposite side of the inlet member, the outlet member, and the relief valve with respect to an imaginary plane including a center axis of the plunger.

23. The high pressure pump according to claim 14, wherein the inlet chamber has an outer circumferential periphery that includes a discontinuous portion with respect to a circumferential direction of the outer circumferential periphery, and the space is located in an outside of the discontinuous portion with respect to the circumferential direction of the outer circumferential periphery.

24. The high pressure pump according to claim 23, wherein the space is on an outer side of the discontinuous portion with respect to a radial direction of the pump housing.

25. The high pressure pump according to claim 23, wherein the outer circumferential periphery of the inlet chamber extends substantially in a circumferential direction of the outer circumferential periphery excluding the discontinuous portion.

26. The high pressure pump according to claim 23, wherein the discontinuous portion is a linear portion that substantially linearly extends from one end of the outer circumferential periphery to an other end of the outer circumferential periphery.

27. A high pressure pump comprising:

an inlet member;

a pump housing that has an inlet chamber and a compression chamber, fluid being drawn from the inlet member into the compression chamber through the inlet chamber, fluid being pressurized in the compression chamber;

an outlet member, through which fluid flows from the compression chamber; and a plunger that is movable in the pump housing for pressurizing fluid in the compression chamber, wherein the inlet chamber has an outer circumferential periphery that includes a linear portion with respect to a circumferential direction of the outer circumferential periphery, the pump housing has a space on a circumferentially outer side of the linear portion, the high pressure pump further comprising:

at least one component that is at least partially accommodated in the space.

28. The high pressure pump according to claim 27, wherein the inlet chamber is arranged on a substantially opposite side of the plunger with respect to the compression chamber, and the inlet chamber expands outwardly in a radial direction of the compression chamber.

29. The high pressure pump according to claim 28, wherein the space is arranged on a side of the compression chamber with respect to the inlet chamber.

30. The high pressure pump according to claim 27, wherein the at least one component includes a control valve that is capable of communicating the inlet chamber with the compression chamber and is capable of blocking the inlet chamber from the compression chamber for controlling an amount of fluid flowing from the outlet member.

31. The high pressure pump according to claim 30, wherein the control valve includes a valve member and a coil, the valve member is at least partially accommodated in the space, the valve member is capable of communicating the inlet chamber with the compression chamber and is capable of blocking the inlet chamber from the compression chamber, the coil is capable of generating magnetic attractive force for operating the valve member, the coil is arranged on a substantially opposite side of the inlet chamber with respect to the valve member, and the coil is arranged on an outer side of the compression chamber with respect to a radial direction of the compression chamber.

32. The high pressure pump according to claim 27, wherein the at least one component includes a relief valve that controls pressure of fluid in a downstream of the outlet member.

33. The high pressure pump according to claim 28, wherein the inlet member and the outlet member are arranged on a side of the compression chamber with respect to the inlet chamber.

34. The high pressure pump according to claim 33, wherein the at least one component includes a relief valve that controls pressure of fluid in a downstream of the outlet member, and the relief valve is arranged circumferentially between the inlet member and the outlet member.

35. The high pressure pump according to claim 34, wherein the at least one component includes a control valve that includes a valve member and a coil, the valve member is capable of communicating the inlet chamber with the compression chamber and is capable of blocking the inlet chamber from the compression chamber for controlling an amount of fluid flowing from the outlet member, the coil is capable of generating magnetic attractive force for operating the valve member, and the control valve is arranged on a substantially opposite side of the inlet member, the outlet member, and the relief valve with respect to an imaginary plane including a center axis of the plunger.

36. The high pressure pump according to claim 27, wherein the space is on an outer side of the linear portion with respect to a radial direction of the pump housing.

37. The high pressure pump according to claim 27, wherein the outer circumferential periphery of the inlet chamber extends substantially in a circumferential direction of the outer circumferential periphery excluding the linear portion.

38. The high pressure pump according to claim 27, wherein the linear portion substantially linearly extends from one end of the outer circumferential periphery to an other end of the outer circumferential periphery.

39. A high pressure pump comprising:

an inlet member;

a pump housing that has an inlet chamber and a compression chamber, the inlet member communicating with the inlet chamber, the inlet chamber being capable of communicating with the compression chamber;

an outlet member that is capable of communicating the compression chamber with an outside of the pump housing; and a plunger that is movable in the pump housing, the plunger partially defining the compression chamber, wherein the inlet chamber has an outer circumferential periphery that extends from a first end of the outer circumferential periphery to a second end of the outer circumferential periphery, the first end extends to the second end to form a defining portion that defines a space in the pump housing, the space being located on an outer side of the defining portion with respect to a circumferential direction of the outer circumferential periphery, the high pressure pump further comprising:

at least one component that is at least partially accommodated in the space.

40. The high pressure pump according to claim 39, wherein the defining portion is a linear portion that substantially linearly extends from the first end of the outer circumferential periphery to the second end of the outer circumferential periphery.

41. The high pressure pump according to claim 39, wherein the defining portion is a discontinuous portion that extends along a locus, which is in a substantially arch shape.

42. The high pressure pump according to claim 39, wherein the at least one component includes at least one of a control valve and the relief valve.

43. A high pressure pump comprising:

an inlet member;

a pump housing that has an inlet chamber and a compression chamber, the inlet member communicating with the inlet chamber, the inlet chamber being capable of communicating with the compression chamber;

an outlet member that is capable of communicating the compression chamber with an outside of the pump housing; and a plunger that is movable in the pump housing, the plunger partially defining the compression chamber, wherein the inlet chamber has a plurality of outer circumferential peripheries, each of the plurality of outer circumferential peripheries has a first end and a second end, the first end extending to the second end in each of the plurality of outer circumferential peripheries, the first end of one of the plurality of outer circumferential peripheries extends to the second end of an other of the plurality of outer circumferential peripheries to define a defining portion, the one of the plurality of outer circumferential peripheries being circumferentially adjacent to the other of the plurality of outer circumferential peripheries, the defining portion defines a space in the pump housing, the space being located on an outer side of the defining portion with respect to a circumferential direction of the outer circumferential periphery, the high pressure pump further comprising:

at least one component that is at least partially accommodated in the space.

44. The high pressure pump according to claim 43, wherein the defining portion is a linear portion that substantially linearly extends from the first end of the outer circumferential periphery to the second end of the outer circumferential periphery.

45. The high pressure pump according to claim 43, wherein the defining portion is a discontinuous portion that extends along a locus, which is in a substantially arch shape.

46. The high pressure pump according to claim 43, wherein the at least one component includes at least one of a control valve and the relief valve.

* * * * *